United States Patent [19]

Horodysky et al.

[11] 4,376,712

[45] Mar. 15, 1983

[54] FRICTION REDUCING ADDITIVES AND COMPOSITIONS THEREOF

[75] Inventors: Andrew G. Horodysky, Cherry Hill; Joan M. Kaminski, Mullica Hill, both of N.J.

[73] Assignee: Mobil Oil Corporation, New York, N.Y.

[21] Appl. No.: 311,582

[22] Filed: Oct. 15, 1981

Related U.S. Application Data

[63] Continuation-in-part of Ser. No. 128,758, Mar. 10, 1980, abandoned.

[51] Int. Cl.[3] ..... C10M 1/54; C07F 5/04

[52] U.S. Cl. ..... 252/49.6; 260/462 R; 549/213

[58] Field of Search ..... 252/49.6; 260/462 R, 260/347.4

[56] References Cited

U.S. PATENT DOCUMENTS

| | | | |
|---|---|---|---|
| 3,533,945 | 10/1970 | Vogel | 252/49.6 |
| 3,544,614 | 12/1970 | Schwartz | 260/462 R |
| 3,772,357 | 11/1973 | Hamanaka | 260/462 R X |
| 4,034,038 | 7/1977 | Vogel | 260/462 R |

*Primary Examiner*—Paul F. Shaver

*Attorney, Agent, or Firm*—Charles A. Huggett; Michael G. Gilman; Claude E. Setliff

[57] ABSTRACT

Borated sorbitan esters provide effective friction reducing properties for lubricating fluids when incorporated therein.

18 Claims, No Drawings

FRICTION REDUCING ADDITIVES AND COMPOSITIONS THEREOF

CROSS REFERENCE TO RELATED APPLICATIONS

This application is a continuation-in-part of U.S. application Ser. No. 128,758, filed Mar. 10, 1980, now abandoned.

BACKGROUND OF THE INVENTION

1. Field of the Invention

This invention relates to lubricant additives and compositions thereof and, more particularly, to lubricant compositions comprising oils of lubricating viscosity or greases prepared therefrom containing a minor friction reducing amount of a borated sorbitan ester.

2. Description of the Prior Art

Many means have been employed to reduce overall friction in modern engines, particularly automobile engines. The primary reasons are to reduce engine wear thereby prolonging engine life and to reduce the amount of fuel consumed by the engine thereby reducing the engine's energy requirements or fuel consumption.

Many of the solutions to reducing fuel consumption have been strictly mechanical, as for example, setting the engines for a leaner burn or building smaller cars and smaller engines. However, considerable work has been done with lubricating oils, mineral and synthetic, to enhance their friction properties by modifying them with friction reducing additives.

Hydroxyesters are known for their friction reducing properties when added to lubricant fluids. However, these hydroxyesters have not found widespread use in many applications because of their inherent inability to control bearing corrosion; it is believed that the poor control of bearing corrosivity of these hydroxyesters is due to the presence of reactive hydroxyl groups. Borated sorbitan esters are better friction reducers than their unborated counterparts and also reduce bearing corrosion to minimal, acceptable levels. It is believed that the conversion of hydroxyl groups to borate esters groups leads to these multiple performance improvements. These borated sorbitan esters to the best of applicant's knowledge and belief are novel and have not been used as friction reducing additives or as anticorrosion or antioxidant additives in lubricating compositions.

The closest prior art known by applicants is exemplified by: U.S. Pat. No. 3,533,945, concerning borated esteralkenyl succinic acid ester of a polyhydric alcohol; U.S. Pat. No. 3,544,614 to complex esters from dibasic acids, polyhydric alcohols and monobasic acid, one polyhydric alcohol being sorbitol; U.S. Pat. No. 3,772,357 teaching, among other things, the product of reaction between sorbitan monolaurate and trimethyl borate; and U.S. Pat. No. 4,034,038 to lubricant compositions containing a product made by reacting, e.g., sorbital, with a succinic acid-producing compound and a boron reactant.

SUMMARY OF THE INVENTION

This invention is directed to novel additive compounds, i.e., borated sorbitan esters. In addition to these novel compounds the invention is also directed to lubricant compositions having reduced friction containing such compounds and to a method of reducing fuel consumption in internal combustion engines by treating the moving surfaces thereof with said compositions. The fuel, e.g., gasoline economy of internal combustion engines is significantly improved by the use of the novel additives in accordance with the present invention. Further the novel compounds referred to herein above also possess significant antioxidant characteristics and bearing corrosion inhibiting properties. It is not necessary to use high purity sorbitan esters to effect these product quality improvements since good results are obtained using commercially available mixtures of sorbitan monoesters and sorbitan diesters. Boration of such sorbitan esters is readily accomplished. The level of boration may be varied, i.e., the sorbitan esters can be partially or extensively borated to yield products containing as little as 0.01% boron. The greater levels of boration, however, impart enhanced properties.

DESCRIPTION OF SPECIFIC EMBODIMENTS

The sorbitan esters may be obtained commercially as stated hereinabove or prepared in any convenient manner known to the art. The sorbitan esters useful in this invention include mono-, di- and triesters. Accordingly these esters will have at least one aliphatic or hydrocarbyl group attached thereto. The length of this group can vary from about 10 to about 30 carbon atoms. Representative ester groups are such as laurate, myristate, palmitate, stearate, phenyl stearate and the like.

The borated derivatives may be produced by any means known in the art, e.g., by direct treatment of the sorbitan ester with boric acid or by transesterification with a trialkyl borate, using a reactant mole ratio of 1 to 1 to 1 to $1\frac{2}{3}$ of the ester and boron compound, respectively. The reactions are usually carried out in the presence of a suitable solvent or solvents, at temperatures ranging from about 90° C. to about 260° C. The solvents can be hydrocarbon solvents such as toluene or xylene, or reactive solvents such as butanol. Specific reaction conditions and molar equivalents of the reactants, well known in the art, determine the nature of the final borated product.

The amount of additive in accordance with the present invention required to be effective in lubricant compositions may range from 0.1 to about 10% by weight of the total lubricant composition. Preferred is from about 0.5 to 5 wt. %. The non-metallic compositions thus provided are effective at said moderate to low concentrations and do not contain any potentially undesirable phosphorus, sulfur or metallic salts. The described additives are suitable for use in a variety of functional fluids such as transmission fluids and hydraulic fluids, etc.

The lubricants contemplated for use herein include both mineral and synthetic hydrocarbon oils of lubricating viscosity, mixtures of mineral and synthetic oils, and greases or other solid lubricants prepared therefrom. The synthetic hydrocarbon oils include long chain alkanes such as cetanes and olefin polymers such as trimers and tetramers of long chain-olefins. These synthetic oils can be mixed with other synthetic oils which include (1) ester oils such as pentaerythritol esters of monocarboxylic acids having 2 to 20 carbon atoms, (2) polyglycol ethers, (3) polyacetals and (4) siloxane fluids. Especially useful among the synthetic esters are those made from polycarboxylic acids and monohydric alcohols. More preferred are the ester fluids made from pentaerythritol, and an aliphatic monocarboxylic acid containing from 1 to 20 carbon atoms, or mixtures of such acids.

Having described the invention in general terms, the following are offered as specific illustrations thereof. It is to be understood they are illustrations only and that the invention is not thereby limited except as by the appended claims.

EXAMPLE 1

Borated Sorbitan Monooleate (1 part by weight of the oleate to 1 part by weight of $H_3BO_3$).

A mixture of commercially obtained sorbitan monooleate (SMO) and sorbitan dioleate (1350 g), boric acid (195 g), and n-butanol (700 g) was refluxed at 100° to 142° C. until the theoretical amount of water, relative to the amount of boric acid charged, formed in the reaction had azeotroped over. The solvent was removed by vacuum distillation yielding a light brown, fluid product.

EXAMPLE 2

Borated Sorbitan Monooleate (1 part by weight of oleate to $1\frac{2}{3}$ parts by weight of $H_3BO_3$)

A mixture of commercially obtained sorbitan monooleate and sorbitan dioleate (1350 g), boric acid (323), and n-butanol (1002 g) was refluxed at 100° to 160° C. until no more water would azeotrope over. Approximately 94% of the theoretical amount of water, based on the amount of boric acid charged, was recovered. The solvent was removed by vacuum distillation yielding a light brown fluid product.

EXAMPLE 3

Borated Sorbitan Monolaurate

A mixture of commercially obtained sorbitan monolaurate and sorbitan dilaurate (2000 g), boric acid (778 g), and toluene was refluxed with agitation at 100° to 140° C. until no more water azeotroped over. Approximately 47% of the theoretical amount of water, based on the amount of boric acid charged, was obtained. The solvent was removed and the residue was filtered yielding a dark brown viscous product.

The additives prepared as above were then incorporated into a fully formulated 5W-20 engine oil and evaluated using the Low Velocity Friction Apparatus. Selected additives were also evaluated in the Double Length CRC L-38 Bearing Corrosion Test.

LOW VELOCITY FRICTION APPARATUS (LVFA)

The Low Velocity Friction Apparatus (LVFA) is used to measure the friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a levercam-motor arrangement.

PROCEDURE the rubbing surfaces and 12–13 ml. of test lubricant are placed on the LVFA. A 500 psi load is applied, and the sliding speed is maintained at 40 fpm at ambient temperature for a few minutes. A plot of coefficients of friction ($U_k$) over a range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 minutes at 250° F., 500 psi, and 40 fpm sliding speed. Freshly polished steel specimens are used for each run. The surface of the steel is parallel ground to 6 to 8 microinches. The percentages by weight are percentages by weight of the total lubricating oil composition, including the usual additive package. The data are percent decrease in friction according to:

$$\frac{(U_k \text{ of oil alone}) - (U_k \text{ of Additive plus oil})}{(U_k \text{ of oil alone})} \times 100$$

Thus, the value for the oil alone would be zero for the form of the data disclosed in the Table below.

CRC L-38 Oxidation Test

| Test Conditions | |
|---|---|
| Purpose | High Temperature Oxidation, Bearing Corrosion, and Deposit Forming characteristics |
| Engine Used | Labeco CLR L-38 single cylinder 3.8" × 3.75" spark ignition |
| Duration, Hrs. | Normally 4 Break-in 40 Run (can be extended 80, 120) |
| Type of Operation | Constant |
| Cycle Description | Constant (Sample oil at 10, 20, 30, and 40 hours) |
| Engine Speed, RPM | 315.0 |
| Approximate Load, BHP | Adjusted to give proper A/F and fuel flow |
| Air/Fuel Ratio | 14:1 |
| Supercharge Pressure, "Hg. | — |
| Intake Air Temperature, °F. | Ambient |
| Crankcase Oil Temperature, °F. | SAE 20, 30, 50 290° SAE 10 275° |
| Jacket Outlet Temperature, °F. | 200° |
| Oil Charge, Quarts | 1.75 |
| Oil Changes at Hrs. | None |
| Fuel Sulfur Level, % | AE 172A 0.01% |
| Fuel Flow lbs/hr. | 4.75 ± 0.25 |
| Major Items Rated | Piston, Connecting Rod Bearing Weight Loss |
| Bearing Weight Loss (mg.) | 40 max. |

TABLE

Friction Reduction and Engine Test Evaluations

| Example No. | (% Wt.) Conc. | Reduction in Coefficient of Friction of LVFA at 5 Ft./Min. | 30 Ft./Min. | Double-Length CRD L-38 Bearing Corrosion Test 80 Hr. |
|---|---|---|---|---|
| Base Fluid[a] | | 0 | 0 | Pass |
| Base Fluid plus Ex. 1 | | | | |
| (borated sorbitan | 4 | 33 | 23 | Pass (3 mg @ 40 hrs. |
| monooleate) (1 mole SMO: | 2 | 32 | 24 | 21 mg @ 80 hrs.) |
| 1 mole boric acid) | 1 | 28 | 18 | |
| Base Fluid plus Ex. 2 | | | | |
| (borated sorbitan | 4 | 25 | 14 | |
| monooleate) (1 mole SMO: | 2 | 16 | 16 | Pass (36 mg @ 80 hrs.) |
| 1⅔ mole boric acid) | 1 | 23 | 17 | Pass (22 mg @ 40 hrs. 25 mg @ 80 hrs.) |
| Base Fluid plus | | | | |
| sorbitan monooleate | 4 | 23 | 18 | (b) |
| | 2 | 2 | 0 | |
| Base Fluid plus Ex. 3 | | | | |
| (borated sorbitan | | | | |
| in monolaurate) | 2 | 35 | 20 | |
| Base Fluid plus | | | | |
| sorbitan monolaurate | 4 | 21 | 20 | (b) |
| | 2 | 6 | 8 | |

[a]A fully formulated engine oil containing 20% (wt.) of additives such as antioxidants, dispersants and detergents having the following general characteristics: KV @ 40° C. = 36.9 cs; KV @ 100° C. = 6.8 cs VI = 143
[b]Non-borated hydroxyesters routinely fail a 40 hour L-38 bearing corrosion test because of excessive bearing weight loss (40 mg maximum).

From the data of the Table it is readily apparent that the subject borated additives significantly improve the friction reducing properties of lubricants and the borated sorbitan esters of the present invention are more efficient friction reducers than their non-borated counterparts while concomitantly increasing fuel economy. The use of additive quantities as low as 1 or 2% of the borated sorbitan esters results in effective reductions of friction when blended into fully formulated automotive engine oils. In addition to being useful at low concentrations, these compositions do not contain any potentially undesirable phosphorous, sulfur or metallic salts, but additionally exhibit good oxidation and bearing-corrosion inhibiting properties. It should be noted that non-borated polyhydroxyesters similar to the borated additives of the invention (see the Table) routinely fail even a single length (40 hr.) L-38 bearing corrosion test because of excessive bearing weight loss of up to about 40 mg.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of this specification and the appended claims.

We claim:

1. A lubricant composition comprising a major proportion of an oil of lubricating viscosity or grease prepared therefrom and a minor effective amount of an additive having friction reducing, anticorrosion, and antioxidant properties comprising a borated sorbitan mono-, di- or triester or mixture of such borated sorbitan esters wherein the ester group or groups thereof comprise a hydrocarbyl radical having from about 10 to about 30 carbon atoms.

2. The composition of claim 1 wherein the additive is borated sorbitan monooleate.

3. The composition of claim 2 wherein said additive is derived from about 1 to 1 molar ratio of sorbitan monooleate and boric acid.

4. The composition of claim 2 wherein said additive is derived from about a 1 to 1⅔ molar ratio of sorbitan monooleate to boric acid.

5. The composition of claim 1 wherein the additive is borated sorbitan dioleate.

6. The composition of claim 1 wherein the additive is borated sorbitan monolaurate.

7. The composition of claim 1 wherein said additive is derived from a mixture of borated sorbitan esters.

8. The composition of claim 7 wherein said mixture comprises borated sorbitan monooleate and borated sorbitan dioleate.

9. The composition of claim 1 wherein said oil is selected from mineral oils, synthetic oils or mixtures of mineral and synthetic oil.

10. The composition of claim 9 wherein the oil is a mineral oil.

11. The composition of claim 9 wherein the oil is a synthetic oil.

12. The composition of claim 1 wherein said lubricant is a grease.

13. An unsaturated borated sorbitan mono-, di- or triester, or mixtures thereof, wherein the ester group or groups thereof comprise a hydrocarbyl radical having from 10 to 30 carbon atoms.

14. The borated ester of claim 13 wherein said compound is borated sorbitan monooleate.

15. The borated ester of claim 13 wherein said compound is borated sorbitan dioleate.

16. The borated ester of claim 13 comprising a mixture of borated sorbitan monooleate and borated sorbitan dioleate.

17. A method of reducing fuel consumption in an internal combustion engine comprising treating the moving surfaces thereof with a lubricant composition as described in claim 1.

18. The method of claim 17 wherein the borated ester is borated sorbitan monooleate.

* * * * *